US008602469B2

(12) United States Patent
Stiles et al.

(10) Patent No.: US 8,602,469 B2
(45) Date of Patent: Dec. 10, 2013

(54) METHOD AND APPARATUS FOR LIFTING CUMBERSOME ARTICLES

(75) Inventors: Franklin Edward Stiles, Georgetown, TN (US); Wesley Bennett Rakestraw, McDonald, TN (US)

(73) Assignee: R&S Systems, LLC, Cleveland, TN (US)

( * ) Notice: Subject to any disclaimer, the term of this patent is extended or adjusted under 35 U.S.C. 154(b) by 314 days.

(21) Appl. No.: 12/500,082

(22) Filed: Jul. 9, 2009

(65) Prior Publication Data

US 2011/0008146 A1 Jan. 13, 2011

(51) Int. Cl.
*B66C 1/44* (2006.01)

(52) U.S. Cl.
USPC ..... 294/104; 294/110.1

(58) Field of Classification Search
USPC ..... 294/62, 63.1, 67.31, 104, 110.1, 110.2, 294/902
See application file for complete search history.

(56) References Cited

U.S. PATENT DOCUMENTS

| | | | | | |
|---|---|---|---|---|---|
| 384,107 | A * | 6/1888 | Wiley | 294/110.1 |
| 1,385,867 | A | 7/1921 | Fuller | |
| 2,370,528 | A * | 2/1945 | Fontaine | 294/197 |
| 2,718,426 | A * | 9/1955 | Nagy | 294/87.1 |
| 2,745,695 | A * | 5/1956 | Peyer | 294/118 |
| 3,011,821 | A * | 12/1961 | Doty | 294/104 |
| 3,068,036 | A * | 12/1962 | Doty | 294/104 |
| 3,697,118 | A * | 10/1972 | Johnstone et al. | 294/110.1 |
| 4,637,645 | A * | 1/1987 | Eriksson | 294/104 |
| 5,039,150 | A * | 8/1991 | Jones et al. | 294/3 |
| 6,550,833 | B2 * | 4/2003 | Haynes | 294/63.1 |

* cited by examiner

*Primary Examiner* — Dean Kramer
(74) *Attorney, Agent, or Firm* — Baker Donelson Bearman Caldwell & Berkowitz, PC

(57) ABSTRACT

Method and apparatus for gripping and lifting heavy and cumbersome objects is disclosed. A slotted safety latch lever assembly permits the pivoting action of an upper tube relative to a main tube, facilitating the gripping and releasing action of arm assemblies at either end of the main tube. The length of the main tube is adjustable, permitting the main tube to shorten or lengthen as needed for gripping the object. The upper tube has a lifting device connector selectively positioned longitudinally relative to the upper tube for achieving correct balance point for lifting.

15 Claims, 1 Drawing Sheet

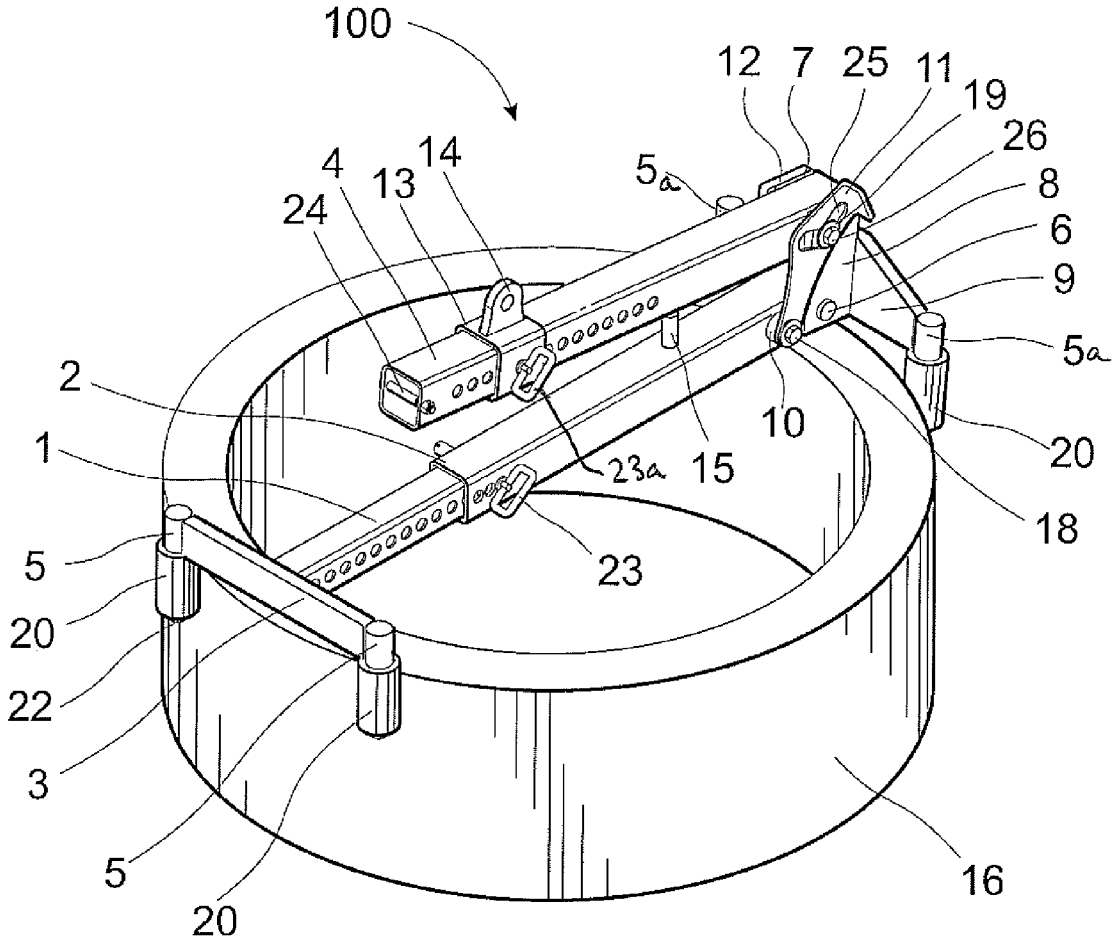
100
12
7
25
11
19
26
8
6
9
5a
5a
20
18
10
15
23a
23
2
1
5
20
22
3
5
20
16
4
13
14
24

METHOD AND APPARATUS FOR LIFTING CUMBERSOME ARTICLES

FIELD OF THE INVENTION

The present invention pertains to a gripping and lifting system for moving cumbersome articles, such as stone or concrete slabs and other large, heavy, construction materials or equipment of varying shapes and sizes.

BACKGROUND OF THE INVENTION

The construction industry today uses many heavy and cumbersome articles, such as pre-cast concrete structures, natural stone, wood, and metal objects, which may be square, rectangular, or even round in shape. Unfortunately, there currently is no method of lifting these items safely. Common practice in the pre-cast concrete industry, for example, is to wrap a log chain or strap of some form around the structure to lift the object.

Many times in this process, it is necessary to attempt to lift the object several times in order to balance or stabilize it. This can result in both injuries to members of the construction crew and damage to the object being lifted. When the object is being set in place, there is an element of risk to the construction workers as they undo the chains or straps. In particular, workers have to use pry bars and wedge blocks to remove the chains and straps from the object, and the positioning of the object is very labor intense. Hand, finger, and back injuries are common results of the current method of lifting cumbersome articles in construction.

The transportation and delivery of these products commonly are achieved with some type of boom truck or lift truck, and normally require a wooden pallet to serve as the lifting surface or support for the object being moved using current methods.

Accordingly, there is a need in the art for an apparatus for lifting cumbersome articles. It is to such that the present invention is directed.

SUMMARY OF THE INVENTION

The present invention meets the need in the art by providing an apparatus for gripping and lifting cumbersome articles comprising a lifting member pivotably connected to a main tube and movable from an open position to a gripping position by movement of the lifting member, a slotted safety latch lever assembly pivotably connected to the main tube and connected to the lifting member by a link extending through the slot in the safety latch lever assembly, with arm assemblies attached at an end of the main tube opposing the pivotable connection between the lifting member and the main tube and attached at the pivotable connection between the lifting member and the main tube for gripping contact of an object to be lifted upon pivoting the lifting member to the gripping position.

In another aspect, the present invention provides a method of gripping and lifting cumbersome objects comprising pivoting an upper tube relative to main tube, and having a slotted safety latch lever assembly pivotably connected to the main tube and movably connected to the upper tube with a linkage extending through the slot in the safety latch lever assembly, such that arm assemblies at either end of the main tube close around an object to be gripped and lifted.

Those skilled in the art will further appreciate the important features and advantages of the invention upon reading the detailed description of the preferred embodiments hereof that follows with reference to the accompanying drawing.

BRIEF DESCRIPTION OF THE DRAWING

FIG. 1 is a perspective view of the gripping and lifting system of the present invention.

DETAILED DESCRIPTION OF PREFERRED EMBODIMENTS

In the description that follows, like elements are marked throughout the specification and the drawing with the same reference numerals.

DETAILED DESCRIPTION

The purpose of the gripping and lifting apparatus of the present invention is to provide a safe, efficient, economical, and versatile way to maneuver heavy or cumbersome items. The present invention may be utilized in construction, shipping, manufacturing, or other applications. One of the features of the present invention is that it is capable of being adjusted along its length to accommodate different sized objects and provide multiple balance points, enhancing its adaptability to different uses.

The present invention provides a construction device capable of gripping and lifting heavy, cumbersome objects of any shape, including round, square, triangular, or rectangular shapes. The invention is manufactured in different size ranges to accommodate a large range of objects, and provides a safe way to pick up, transport, and place heavy objects. Because the invention safely grasps the top edges of the heavy object from above, there is no need to have multiple workers in harm's way handling the object while attempting to secure or release heavy chains, straps, or other fastening devices. Moreover, the invention is an enhanced time saver when moving any heavy object due to the ease of grasping the object from above. In addition, the present invention eliminates the need to transport such items on wooden pallets.

Referring to FIG. 1, an embodiment of the gripping and lifting apparatus 100 of the present invention is shown gripping object 16. Sliding arm 1 is a steel structure drilled incrementally to provide spaced-apart holes along its length to allow multiple positions for pin 23 to engage sliding arm 1 telescopically within main tube 2, which also is a steel structure having multiple spaced-apart holes for engaging pin 23. Sliding arm 1, steel bar 3, and round steel bars 5 are welded together to form one piece.

Upper tube 4, round bars 5*a*, pivot pins 6, spacers 7, pivot block 8, steel cross bar 9, and pivot block 12 are one welded assembly that forms the pivoting clamp mechanism. Upper tube 4 is a steel structure lifting member drilled incrementally to provide spaced-apart holes along its length to allow multiple positions for pin positioner 13 to be placed and pinned by pin 23*a*, providing multiple balance points when objects 16 are lifted. The bolt 24 in the end of upper tube 4 is for safety, to prevent pin positioner 13 from sliding completely off upper tube 4. In an alternate embodiment (not illustrated), a lifting device connector extends from the upper tube 4 for connecting to a lifting device.

Safety latch lever 11 moves between a first position and a second position. FIG. 1 depicts the safety latch lever 11 in an intermediate position. In the first position, the safety lever latch 11 keeps the gripping and lifting apparatus 100 open until activated by an operator. Safety latch lever 11 is pivotably held onto the main tube 2 at bolt receptacle 10 with a bolt and washer 18 and connects with a linkage 26 through the slot 25 in the safety latch lever 11. Pivot pin 6 defines a pivot axis and permits the pivoting of upper tube 4 and pivot block 8 relative to the main tube 2 at the pivot point/latch works. The lifting member or upper tube 4 and the pivot block 8 pivots on the pivot axis by virtue of the forward and backward movement of safety latch lever 11 in V-shaped slot 25. A roller pin/bolt and washer assembly 19 connects to block 8, and as the linkage 26, permits the movement of the safety latch/lever 11 along the V-shaped slot 25. In an alternate embodiment, the roller pin is a member extending through aligned openings in the opposing block 12, spacers 7, and tube 4. Grade 8 steel is preferred for the fabrication of bolt and washers 18 and 19.

Objects to be lifted 16 are protected from damage by sleeves 20 attached to the bars 5 and 5*a*, such as held onto the bars by washers and bolts 22. Grade 8 steel is preferred for the fabrication of washers and bolts 22. The sleeves 20 serve both to protect object 16 as well as provide enhanced gripping. Urethane is preferred for the fabrication of sleeves 20, but other resilient or cushion materials are suitable.

When the gripping and lifting apparatus 100 of the present invention is adjusted properly onto object 16, the operator pushes safety latch lever 11 forward (a direction away from the pivot pin 6). FIG. 1 depicts the safety latch lever 11 in an intermediate position after the safety latch lever 11 is pushed forward. As the operator then starts the lifting action, the main tube assembly 4 and pivot block 8 pivots on pin 6, creating a clamping action between the bars 5, 5*a* and resulting in a gripping force exerted on object 16, allowing object 16 to be lifted and moved as desired. It will be appreciated that as soon as safety latch lever 11 is pushed forward, the release and consequent upward movement of upper tube 4 will cause the item 16 to be frictionally held between the inner surfaces of sleeves 20.

When object 16 is ready to be placed in position, the operator simply lowers object 16 to its desired resting point. It is contemplated that a conventional crane is used to lift object 16 by attaching a hook or other device to lifting device receptacle 14. Upon placement, the gripping and lifting apparatus 100 of the present invention releases. This is accomplished by upper tube 4 that pivots on pin 6 towards the main tube assembly, opening the clamping action of the apparatus 100. When upper tube 4 drops to stop item 15, the safety latch lever 11 releases the latching. The gripping and lifting apparatus 100 is then in the open position for removal from the object 16 that was moved.

A major difference between previous gripping and lifting methodology and the present invention is the way in which the inherent problem of lifting from underneath a heavy or cumbersome article is eliminated. This is a key difference that allows the present invention to be safer, faster, and far less expensive in terms of labor cost savings, workers' compensation claim savings, medical expense savings, and savings from reduced damage to moved items.

The operation of the gripping and lifting device for the advantageous purposes set forth herein is believed to be understandable to those of ordinary skill in the art based on the foregoing description.

The benefits of the instant invention are many, and include the following: (1) usable with objects of any shape and size; (2) reduces manpower needed to perform lifting and moving heavy or cumbersome objects; (3) reduces time needed to perform lifting and moving heavy or cumbersome objects; and (4) eliminates the need to transport moving heavy or cumbersome objects on wooden pallets. Further, the present invention is the only such device and method that accomplishes all these advantages, despite the existence of a worldwide, ancient, construction industry faced with the problem of moving heavy and cumbersome objects on a daily basis. Although preferred embodiments of the invention have been described in detail herein, those skilled in the art will also recognize that various substitutions and modifications may be made without departing from the scope and spirit of the appended claims.

What is claimed is:

1. An apparatus for gripping and lifting cumbersome articles comprising:

(a) a pair of gripping members mounted at either end of an end bar having a sliding arm mounted thereto, the sliding arm having a plurality of holes along its length;

(b) a main tube for receiving the sliding arm, the main tube having a plurality of holes along its length and adapted to receive the sliding arm at a first end, and further having a fastener receptacle and a pivot hole at a second end, which pivot hole is adapted to receive a pivot pin;

(c) a pin for engaging the sliding arm within the main tube by insertion first through a selected hole along the length of the main tube and then through a selected hole along the length of the sliding arm;

(d) a safety latch lever, pivotably mounted to the fastener receptacle of the main tube at a first end of the safety latch lever, said safety latch lever having a V-shaped slot at a second end;

(e) an upper tube having holes along its length and adapted to receive at a first end a pin positioner having a lifting device receptacle, a pivot block mounted to the second end of the upper tube and a cross bar attached thereto, said cross bar having a pair of gripping members mounted at either end, and a pivot pin extending through the pivot block and the second end of the main tube;

(f) a pin for engaging the upper tube within the pin positioner by insertion first through a hole along the length of the pin positioner and then through a hole along the length of the upper tube; and (g) means for connecting the safety latch lever through its slot to the upper tube.

2. The apparatus for gripping and lifting cumbersome articles of claim 1, wherein the apparatus is constructed of steel.

3. The apparatus for gripping and lifting cumbersome articles of claim 1, wherein the means for connecting the safety latch lever is a bolt and washer.

4. The apparatus for gripping and lifting cumbersome articles of claim 1, wherein means for connecting comprises a roller pin extending through the slot and engaged to the upper tube.

5. An apparatus for gripping and lifting cumbersome articles comprising:

(a) a main tube for telescopically receiving a sliding arm for selective positioning relative to a cumbersome article to be lifted, the main tube having a first end for receiving the sliding tube and an opposing second end;

(b) means for securing the main tube and the sliding arm together at a selected length;

(c) a pair of end bars each having opposing pairs of gripping members, a first one of the end bars attached to an end of the sliding arm and a second one of the end bars attached to a pivot block at the second end of the main tube, the gripping members for selectively bearing against surfaces of the cumbersome article to be lifted;

(d) a lifting member pivotably attached at one end to the pivot block at the second end of the main tube;

(e) a lever pivotably connected to the main tube and defining a V-shaped slot in a remote portion;

(f) means for connecting the lever through its slot to an upper tube, (g) whereby pivoting the lifting member in a direction away from the main tube causes the gripping members to bear forcibly against the cumbersome article for lifting.

6. The apparatus for gripping and lifting cumbersome articles of claim 5, wherein means for securing comprises:

(a) the main tube and the sliding arm each define a plurality of spaced-apart holes along respective longitudinal lengths, and (b) a pin for engaging the sliding arm within the main tube at the selected length by extending through respective aligned holes in the main tube and the sliding arm.

7. The apparatus for gripping and lifting cumbersome articles of claim 5 wherein the lifting member further comprises a lifting device receptacle for connecting with a lifting device.

8. The apparatus for gripping and lifting cumbersome articles of claim 5, wherein the lifting member defines a plurality of holes spaced-apart longitudinally; and further comprising:

(a) a pin positioner slidably received on the lifting member and having a lifting device receptacle, the pin positioner defining a hole therein for alignment with a selected one of the holes in the lifting member; and (b) a pin for extending through the hole in the pin positioner and the aligned hole in the lifting member for selectively fixing the lifting device receptacle for connecting with a lifting device.

9. The apparatus for gripping and lifting cumbersome articles of claim 5, further comprising resilient sleeves received on the gripping members.

10. The apparatus for gripping and lifting cumbersome articles of claim 5, further comprising a stop member disposed between the main tube and the lifting member.

11. An apparatus for gripping and lifting cumbersome articles comprising:

(a) a lifting member pivotably connected to a main tube and movable from an open position to a gripping position by movement of the lifting member;

(b) a slotted safety latch lever assembly pivotably connected to the main tube and connected to the lifting member with a linkage extending through the slot in the safety latch lever assembly; and (c) arm assemblies attached at one end of the main tube and at the pivotable connection of the lifting member and the main tube for opposing gripping contact of an object to be lifted upon pivoting the lifting member to the gripping position, each of the arm assemblies having a pair of spaced-apart round bars extending in a first direction and a pair of resilient sleeves, each sleeve received on a respective one of the round bars, for gripping the object between the opposing pairs of round bars.

12. The apparatus for gripping and lifting cumbersome articles of claim 11, wherein the main tube comprises a receiving tube and a telescopically received sliding arm selectively positioned for disposing the arm assemblies against respective surfaces of the object and with one of the arm assemblies attached to the sliding arm.

13. The apparatus for gripping and lifting cumbersome articles of claim 12, further comprising means for securing the receiving tube and the sliding arm in a selected length.

14. The apparatus for gripping and lifting cumbersome articles of claim 11 wherein the lifting member further comprises a lifting device receptacle for connecting with a lifting device.

15. The apparatus for gripping and lifting cumbersome articles of claim 11, wherein the lifting member defines a plurality of holes spaced-apart longitudinally; and further comprising:

(a) a pin positioner slidably received on the lifting member and having a lifting device receptacle, the pin positioner defining a hole therein for alignment with a selected one of the holes in the lifting member; and (b) a pin for extending through the hole in the pin positioner and the aligned hole in the lifting member for selectively fixing the lifting device receptacle for connecting with a lifting device.

* * * * *